US009034240B2

(12) United States Patent
Sharma et al.

(10) Patent No.: US 9,034,240 B2
(45) Date of Patent: May 19, 2015

(54) ELECTROSPINNING PROCESS FOR FIBER MANUFACTURE

(71) Applicants: Upma Sharma, Somerville, MA (US); Quynh Pham, Metheun, MA (US); John Marini, Weymouth, MA (US)

(72) Inventors: Upma Sharma, Somerville, MA (US); Quynh Pham, Metheun, MA (US); John Marini, Weymouth, MA (US)

(73) Assignee: Arsenal Medical, Inc., Watertown, MA (US)

( * ) Notice: Subject to any disclaimer, the term of this patent is extended or adjusted under 35 U.S.C. 154(b) by 340 days.

(21) Appl. No.: 13/758,208

(22) Filed: Feb. 4, 2013

(65) Prior Publication Data

US 2013/0313758 A1 Nov. 28, 2013

Related U.S. Application Data

(63) Continuation-in-part of application No. 13/362,467, filed on Jan. 31, 2012, now Pat. No. 8,968,626.

(60) Provisional application No. 61/437,886, filed on Jan. 31, 2011.

(51) Int. Cl.

| | |
|---|---|
| ***D01D 7/00*** | (2006.01) |
| ***D01D 5/00*** | (2006.01) |
| ***D01D 5/34*** | (2006.01) |

(52) U.S. Cl.

CPC ..... *D01D 5/0069* (2013.01); *D01D 5/0076* (2013.01); *D01D 5/0038* (2013.01); *D01D 5/34* (2013.01)

(58) Field of Classification Search

CPC .. B29C 47/065; D01D 5/0007; D01D 5/0015; D01D 5/0023; D01D 5/003; D01D 5/0038; D01D 5/0046; D01D 5/0053; D01D 5/0061; D01D 5/0069; D01D 5/0076; D01D 5/0084; D01D 5/0092; D01D 5/30; D01D 5/34; D01D 7/00

USPC ..... 264/10, 172.11, 172.15, 173.16, 264/173.17, 173.18, 173.19, 174.1, 174.11, 264/211.12, 464, 465, 466, 484

See application file for complete search history.

(56) References Cited

U.S. PATENT DOCUMENTS

| | | | |
|---|---|---|---|
| 4,764,377 | A | 8/1988 | Goodson |
| 5,364,627 | A | 11/1994 | Song |

(Continued)

FOREIGN PATENT DOCUMENTS

| | | | |
|---|---|---|---|
| WO | WO-94/18956 | A1 | 9/1994 |
| WO | WO-98/53768 | A1 | 12/1998 |

(Continued)

OTHER PUBLICATIONS

Bini, T.B. et al., "Electrospun poly(L-lactide-co-glycolide) biodegradable polymer nanofiber tubes for peripheral nerve regeneration", Nanotechnology, 15, 2004, 1459-1464.

(Continued)

*Primary Examiner* — Leo B Tentoni

(74) *Attorney, Agent, or Firm* — Kacvinsky Daisak Bluni PLLC

(57) ABSTRACT

Devices and methods for high-throughput manufacture of concentrically layered nanoscale and microscale fibers by electrospinning are disclosed. The devices include a hollow tube having a lengthwise slit through which a core material can flow, and can be configured to permit introduction of sheath material at multiple sites of Taylor cone formation formation.

16 Claims, 8 Drawing Sheets

(56) References Cited

U.S. PATENT DOCUMENTS

| | | | |
|---|---|---|---|
| 5,538,735 | A | 7/1996 | Ahn |
| 5,567,612 | A | 10/1996 | Vacanti et al. |
| 5,569,528 | A | 10/1996 | Van der Loo et al. |
| 5,700,476 | A | 12/1997 | Rosenthal et al. |
| 5,842,477 | A | 12/1998 | Naughton et al. |
| 5,922,340 | A | 7/1999 | Berde et al. |
| 5,944,341 | A | 8/1999 | Kimura et al. |
| 5,980,927 | A | 11/1999 | Nelson et al. |
| 6,086,911 | A | 7/2000 | Godbey |
| 6,214,370 | B1 | 4/2001 | Nelson et al. |
| 6,382,526 | B1 | 5/2002 | Reneker et al. |
| 6,495,124 | B1 | 12/2002 | Samour |
| 6,520,425 | B1 | 2/2003 | Reneker |
| 6,524,608 | B2 | 2/2003 | Ottoboni et al. |
| 6,596,296 | B1 | 7/2003 | Nelson et al. |
| 6,655,366 | B2 | 12/2003 | Sakai |
| 6,676,953 | B2 | 1/2004 | Hexamer |
| 6,676,960 | B2 | 1/2004 | Saito et al. |
| 6,685,956 | B2 | 2/2004 | Chu et al. |
| 6,685,957 | B1 | 2/2004 | Bezemer et al. |
| 6,689,374 | B2 | 2/2004 | Chu et al. |
| 6,695,992 | B2 | 2/2004 | Reneker |
| 6,712,610 | B2 | 3/2004 | Abdennour et al. |
| 6,716,449 | B2 | 4/2004 | Oshlack et al. |
| 6,737,447 | B1 | 5/2004 | Smith et al. |
| 6,753,454 | B1 | 6/2004 | Smith et al. |
| 6,821,479 | B1 | 11/2004 | Smith et al. |
| 6,855,366 | B2 | 2/2005 | Smith et al. |
| 6,858,222 | B2 | 2/2005 | Nelson et al. |
| 6,861,142 | B1 | 3/2005 | Wilkie et al. |
| 6,861,570 | B1 | 3/2005 | Flick |
| 6,913,760 | B2 | 7/2005 | Carr et al. |
| 7,029,495 | B2 | 4/2006 | Stinson |
| 7,033,603 | B2 | 4/2006 | Nelson et al. |
| 7,033,605 | B2 | 4/2006 | Wong |
| 7,048,913 | B2 | 5/2006 | Hexamer |
| 7,048,946 | B1 | 5/2006 | Wong et al. |
| 7,074,392 | B1 | 7/2006 | Friedman et al. |
| 7,135,194 | B2 | 11/2006 | Birnbaum |
| 7,172,765 | B2 | 2/2007 | Chu et al. |
| 7,198,794 | B1 | 4/2007 | Riley |
| 7,214,506 | B2 | 5/2007 | Tatsumi et al. |
| 7,235,295 | B2 | 6/2007 | Laurencin et al. |
| 7,285,266 | B2 | 10/2007 | Vournakis et al. |
| 7,309,498 | B2 | 12/2007 | Belenkaya et al. |
| 7,323,190 | B2 | 1/2008 | Chu et al. |
| 7,462,362 | B2 | 12/2008 | Kepka et al. |
| 7,678,366 | B2 | 3/2010 | Friedman et al. |
| 7,737,060 | B2 | 6/2010 | Strickler et al. |
| 7,765,647 | B2 | 8/2010 | Smith et al. |
| 7,799,965 | B2 | 9/2010 | Patel et al. |
| 7,803,395 | B2 | 9/2010 | Datta et al. |
| 7,824,699 | B2 | 11/2010 | Ralph et al. |
| 7,959,616 | B2 | 6/2011 | Choi et al. |
| 7,959,848 | B2 | 6/2011 | Reneker et al. |
| 7,959,904 | B2 | 6/2011 | Repka |
| 7,997,054 | B2 | 8/2011 | Bertsch et al. |
| 8,257,614 | B2 | 9/2012 | Gu et al. |
| 2001/0021873 | A1 | 9/2001 | Stinson |
| 2002/0176893 | A1 | 11/2002 | Wironen et al. |
| 2003/0017208 | A1 | 1/2003 | Ignatious et al. |
| 2003/0068353 | A1 | 4/2003 | Chen et al. |
| 2003/0118649 | A1 | 6/2003 | Gao et al. |
| 2003/0195611 | A1 | 10/2003 | Greenhalgh et al. |
| 2004/0030377 | A1 | 2/2004 | Dubson et al. |
| 2004/0076661 | A1 | 4/2004 | Chu et al. |
| 2004/0267362 | A1 | 12/2004 | Hwang et al. |
| 2005/0033163 | A1 | 2/2005 | Duchon et al. |
| 2005/0042293 | A1 | 2/2005 | Jackson et al. |
| 2005/0106211 | A1 | 5/2005 | Nelson et al. |
| 2005/0276841 | A1 | 12/2005 | Davis et al. |
| 2006/0024350 | A1 | 2/2006 | Varner et al. |
| 2006/0153815 | A1 | 7/2006 | Seyda et al. |
| 2006/0293743 | A1 | 12/2006 | Andersen et al. |
| 2007/0087027 | A1 | 4/2007 | Greenhalgh et al. |
| 2007/0155273 | A1 | 7/2007 | Chu et al. |
| 2007/0232169 | A1 | 10/2007 | Strickler et al. |
| 2007/0293297 | A1 | 12/2007 | Schugar |
| 2008/0053891 | A1 | 3/2008 | Koops et al. |
| 2008/0281350 | A1 | 11/2008 | Sepetka et al. |
| 2009/0155326 | A1 | 6/2009 | Mack et al. |
| 2009/0196905 | A1 | 8/2009 | Spada et al. |
| 2010/0184530 | A1 | 7/2010 | Johnson |
| 2010/0249913 | A1 | 9/2010 | Datta et al. |
| 2010/0291182 | A1 | 11/2010 | Palasis et al. |
| 2010/0318108 | A1 | 12/2010 | Datta et al. |

FOREIGN PATENT DOCUMENTS

| | | | |
|---|---|---|---|
| WO | WO-01/32229 | A1 | 5/2001 |
| WO | WO-03/020161 | A2 | 3/2003 |
| WO | WO-2007/052042 | A2 | 5/2007 |
| WO | WO-2008/013713 | A2 | 1/2008 |
| WO | WO-2008/085199 | A2 | 7/2008 |

OTHER PUBLICATIONS

Biomedical Structures, Glossary: Common Biomedical Textile Terms (accessed Oct. 12, 2011), 1-11 pgs.

Cui, W. et al., "Electrospun fibers of acid-labile biodegradable polymers with acetal groups as potential drug carriers", International Journal of Pharmaceutics, vol. 361 (1-2), pp. 47-55, (2008).

Gyeong-Man, Kim et al., "Electrospun PVA/HAp nanocomposite nanofibers: biomimetics of mineralized hard tissues at lower level of complexity", Bioinspiration & Biomimetics, vol. 3(4), pp. 1-12, (2008).

Huang, Zheng-Ming et al., "A review on polymer nanofibers and electrospinning and their applications in nanocomposites", Composites Science and Technology, 63:2223-2253, (2003).

Jose, Moncy V. et al., "Fabrication and characterization of aligned nanofibrous FLGA/Collagen blends as bone tissue scaffolds", Polymer, 50:3778-3785, (2009).

Kanani et al., "Review on Electrospul Nanofibers Scaffold and Biomedical Applications", Trends Biomater. Artif. Organs, vol. 24(2), 93-115, (2010).

Kim, Chan et al., "Characteristics of supercapaitor electrodes of PBI-based carbon nanofiber web prepared by electrospinning", Electrochimica Acta 50:877-881, (2004).

Kostakova, Eva et al., "Composite nanofibers produced by modified needleless electrospinning", Materials Letters, 63:2419-2422, (2009).

Li, Wan-Ju, et al., "Biological response of chondrocytes cultured in three-dimensional nanofibrous poly(?-caprolactone) scaffolds" Journal of Biomed Mater Research, 67:1105-1114, (2003).

Liao, Yiliang et al., "Preparation, characterization, and encapsulation/release studies of a composite nanofiber mat electrospun from an emulsion containing poly(lactic-co-glycolic acid)", Polymer, 49:5294-5299, (2008).

Liang, Dehai et al., "Functional electrospun nanofibrous scaffolds for biomedical applications." Advanced Drug Delivery Reviews 59:1392-1412, (2007).

Liu, Shih-Jung et al. "Electrospun PLGA/collagen nanofibrous membrane as early-stage would dressing" Journal of Membrane Science, 355:53-59, (2010).

Lowery, Joseph L. et al., "Effect of fiber diameter, pore size and seeding method on growth of human dermal fibroblasts in electrospun poly(ϵ-caprolactone) fibrous mats" Biomaterials, 31:491-504, (2010).

Lukas, David, et al., "Self-organization of jets in electrospinning from free liquid surface: A generalized approach", Journa lof Applied Physics, 103, 084309, (2008).

McCann, Jesse T. et al., "Electrospinning of nanofibers with core-sheath, hollow, or porous structures", Journal of Materials Chemistry, 15:735-738, (2005).

Park, Jeong-Ho et al., "Coaxial electrospinning of self-healing coatings" Advanced Materials 22:496-499, (2010).

Petrik, Stanislav et al., "Production nozzle-less electrospinning nanofiber technology" V Horkach 76/18, CZ-46007.

(56) References Cited

OTHER PUBLICATIONS

Pham, Quynh P. et al., "Electrospun poly(ϵ-caprolactone) microfiber and multilayer nanofiber/microfiber scaffolds: characterization of scaffolds and measurement of cellular infiltration", Biomacromolecules, 7:2796-2805, (2006).
Ren, Guanglei, et al., "Electrospun poly(vinyl alcohol)/glucose oxidase biocomposite membranes for biosensor applications" Reactive & Functional Polymers, 66:1559-1564, (2006).
Reneker, Darrell H. et al., "Nanometre diameter fibres of polymer, produced by electrospinning", Nanotechnology, 7:216-223, (1996).
Rhee et al, "Treatment of type II endoleaks with a novel polyurethane thrombogenic foam; Induction of endoleak thrombosis and elimination of intra-aneurysmal pressure in the canine model" Journal of Vascular Studies, 42:2, 321-328, (2005).
Rutledge, Gregory C., et al., "Formation of fibers by electrospinning", Advanced Drug Delivery Reviews, 59:1384-1391, (2007).
Sawicka, Katarzyna M. et al., "Electrospun composite nanofibers for functional applications", Journal of Nanoparticle Research, 8:769-781, (2006).
Sell, S.A., et al., "Electrospun polydioxanone-elastin blends: potential for bioresorbable vascular grafts". Biomedical Materials, 72-80, (2006).
Sy, Jay C. et al., "Emulsion as a Means of Controlling Electrospinning of Polymers", Advanced Materials, 21, 2009, 1814-1819.
Tan, Songting, et al., "Mini-review some fascinating phenomena in electrospinning processes and applications of electrospun nanofibers" Polymer International 56:1330-1339, (2007).
Theron, S.A. et al., "Multiple jets in electrospinning: experiment and modeling" Polymer, 46:2889-2899, (2005).
Varabhas, J.S., et al., "Electrospun nanofibers from a porous hollow tube" Polymer, 49:4226-4229, (2008).
Vonch, J. et al., "Electrospinning: A study in the formation of nanofibers", Journal of Undergraduate Research 1, 1, (2007).
Wang, Miao, et al., "Electrospinning of silica nanochannels for single moleculre detection", Applied Physics Letters, 88, 033106, (2006).
Wang, Xin, et al., "Needless electrospinning of nanofibers wtih a conical wire coil" Polymer Engineering and Science, 1583-1586 (2009).
Wei, Kai et al., "Emulsion Electrospinning of a Collegen-like Protein/PLGA Fibrous Scaffold: Empirical Modeling and Preliminary Release Assessment of Encapsulated Protein", Macromolecular Bioscience, 11:1526-1536, (2011).
Wu, Dezhi et al., "High throughput tip-less electrospinning via a circular cylindrical electrode", Journal of Nanoscience and Nanotechnology, 10:1-6, (2010).
Wutticharoenmongkol, Patcharaporn et al. "Preparation and characterization of novel bone scaffolds based on electrospun polycaprolactone fibers", Macromolecular Bioscience, vol. 6(1), pp. 70-77, (2006).
Xu, X. et al. "BCNU-loaded PEG-PLLA ultrafine fibers and their in vitro antitumor activity against Glima C6 cells", Journal of Controlled Release, vol. 114(3), pp. 307-316, (2006).
International Search Report mailed Jan. 18, 2011 for International Application No. PCT/US2010/057010 (3pgs).
International Search Report mailed Jan. 9, 2011 for International Application No. PCT/US2011/44448 1pg).
International Search Report mailed Dec. 7, 2012 for International Application No. PCT/US12/0555361.

a. b.

ELECTROSPINNING PROCESS FOR FIBER MANUFACTURE

CROSS REFERENCE TO RELATED APPLICATIONS

The present invention claims priority to U.S. Provisional Application No. 61/437,886 entitled "Electrospinning Process for Fiber Manufacture," filed Jan. 31, 2011; and to U.S. application Ser. No. 13/362,467 entitled "Electrospinning Process for Manufacture of Multi-Layered Structures," filed Jan. 31, 2012 now U.S. Pat. No. 8,968,626.

FIELD OF THE INVENTION

The present invention relates to systems and methods for the manufacturing of microscale or nanoscale concentrically-layered fibers by electrospinning.

BACKGROUND

Macro-scale structures formed from concentrically-layered nanoscale or microscale fibers ("core-sheath fibers") are useful in a wide range of applications including drug delivery, tissue engineering, nanoscale sensors, self-healing coatings, and filters. On a commercial scale, the most commonly used techniques for manufacturing core-sheath fibers are extrusion, fiber spinning, melt blowing, and thermal drawing. None of these methods, however, are ideally suited to producing drug-loaded core-sheath fibers, as they all utilize high temperatures which may be incompatible with thermally labile materials such as drugs or polypeptides. Additionally, fiber spinning, extrusion and melt-blowing are most useful in the production of fibers with diameters greater than ten microns.

Core-sheath fibers can be produced by electrospinning in which an electrostatic force is applied to a polymer solution to form very fine fibers. Conventional electrospinning methods utilize a charged needle to supply a polymer solution, which is then ejected in a continuous stream toward a grounded collector. After removal of solvents by evaporation, a single long polymer fiber is produced. Core-sheath fibers have been produced using emulsion-based electrospinning methods, which exploit surface energy to produce core-sheath fibers, but which are limited by the relatively small number of polymer mixtures that will emulsify, stratify, and electrospin. Core-sheath fibers have also been produced using coaxial electrospinning, in which concentric needles are used to eject different polymer solutions: the innermost needle ejects a solution of the core polymer, while the outer needle ejects a solution of the sheath polymer. This method is particularly useful for fabrication of core-sheath fibers for drug delivery in which the drug-containing layer is confined to the center of the fiber and is surrounded by a drug-free layer. However, both emulsion and coaxial electrospinning methods can have relatively low throughput, and are not ideally suited to large-scale production of core-sheath fibers. To increase throughput, coaxial nozzle arrays have been utilized, but such arrays pose their own challenges, as separate nozzles may require separate pumps, the multiple nozzles may clog, and interactions between nozzles may lead to heterogeneity among the fibers collected. Another means of increasing throughput, which utilizes a spinning drum immersed in a bath of polymer solution, has been developed by the University of Liberec and commercialized by Elmarco, S.R.O. under the mark Nanospider®. The Nanospider® improves throughput relative to other electrospinning methods, but it is not currently possible to manufacture core-sheath fibers using the Nanospider®. There is, accordingly, a need for a mechanically simple, high-throughput means of manufacturing core-sheath fibers.

SUMMARY OF THE INVENTION

The present invention addresses the need described above by providing a system and method for high-throughput production of core-sheath fibers.

In one aspect, the present invention relates to a device for high-throughput production of core-sheath fibers by electrospinning The device comprises a hollow tube having a lengthwise slit therethrough, which can be filled with a solution of the core polymer, and optionally includes a bath in which the hollow tube is immersed, which can be filled with a solution of the sheath polymer. The tube also optionally includes structural features such as channels or regions of texture or smoothness through which the sheath polymer solution can run. In an alternate embodiment, the device comprises three adjacent troughs arranged so that two external troughs sandwich a central trough. The central trough is filled with a solution of the core polymer, while the external troughs are filled with solutions of the sheath polymer.

In another aspect, the present invention relates to a device for collection of electrospun fibers in yarn form. The device comprises a grounded collector for electrospun yarns, the collector being configured to rotate so that fibers are twisted into yarns as they are collected from an electrospinning apparatus.

In yet another aspect, the present invention relates to methods of making core-sheath fibers and electrospun yarns using the devices of the present invention.

BRIEF DESCRIPTION OF THE DRAWINGS

In the drawings, like reference characters generally refer to the same parts throughout the different views. Drawings are not necessarily to scale, as emphasis is placed on illustration of the principles of the invention

DETAILED DESCRIPTION OF THE PREFERRED EMBODIMENTS

The present invention relates to electrospun fibers, including drug-containing electrospun fibers and yarns described in co-pending U.S. patent application Ser. No. 12/620,334

(United States Publication No. 20100291182), the entire disclosure of which is incorporated herein by reference.

Figure 1A:
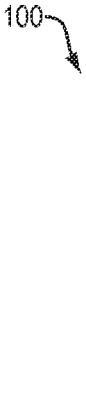
FIG. 1A-1D show schematic illustrations of a fiber generated by the present invention.
Figure 1B:
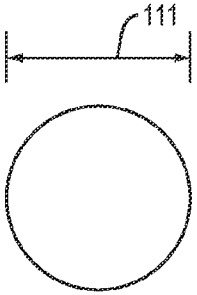
Figure 1C:
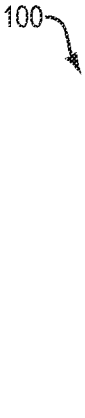
Figure 1D:
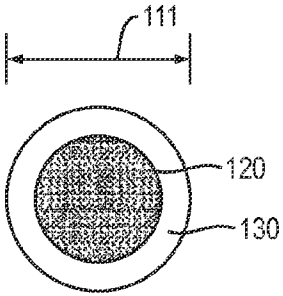

An example of a fiber produced by the devices and methods of the present invention is shown schematically in FIGS. 1*a* and 1*b*. Fiber 100 is generally tubular in shape, and is characterized by a length 110 and a diameter 111. Fibers generated by the devices and methods of the present invention are generally small enough to be useful for implantation to address a wide range of medical applications. As such, the fiber 100 has a diameter that is preferably up to about 20 microns. The length 110 of fiber 100 will vary depending on its intended use, and may range widely from micrometers to centimeters or greater. In a preferred embodiment, fiber 100 includes an inner radial portion 120 and an outer radial portion 130, as shown in FIGS. 1*c* and 1*d*. In this preferred embodiment, the total diameter 111 of the fiber is no more than about 20 microns, and the diameter of the outer radial portion is about 1-7 microns larger than the inner radial portion.

Figure 2:
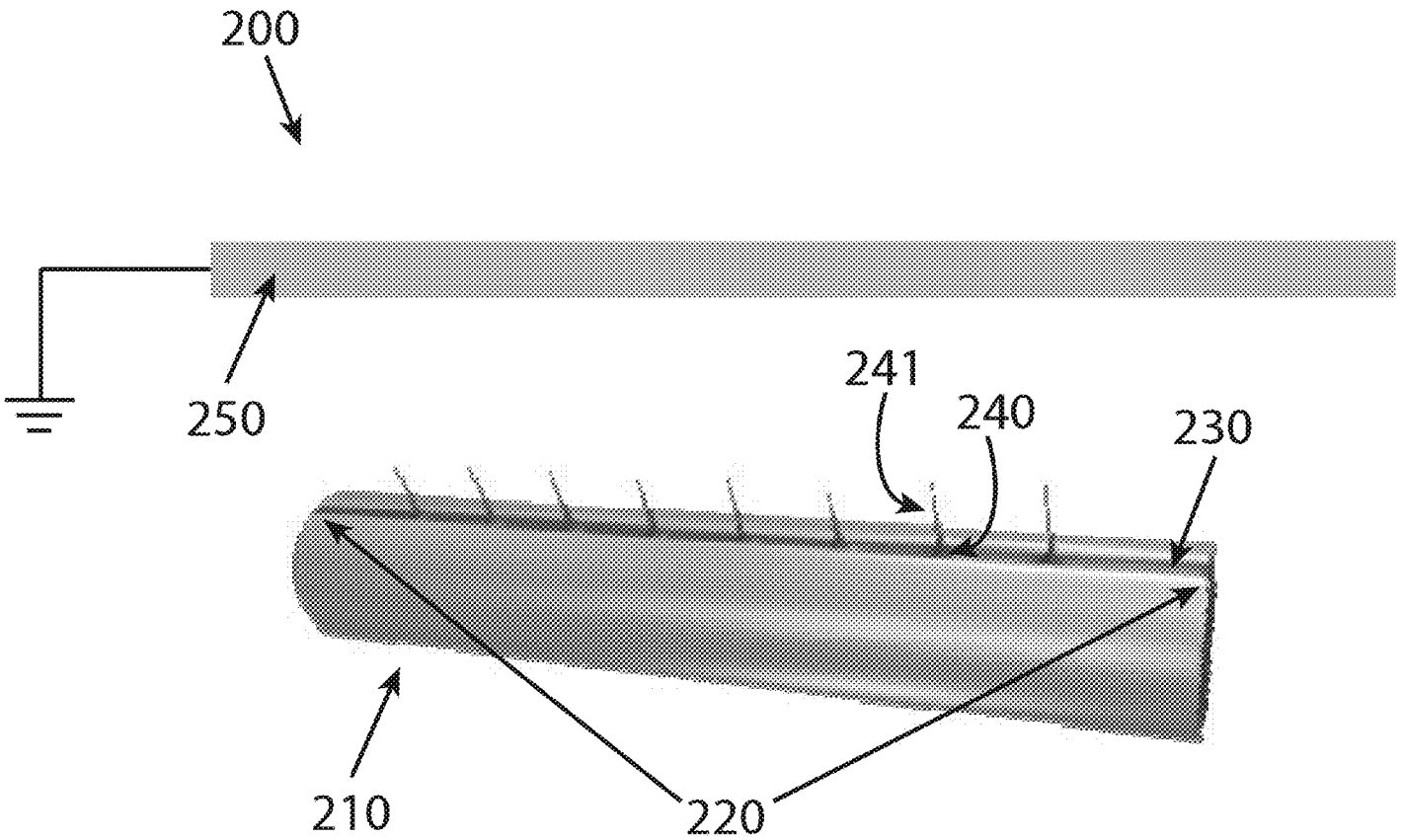
FIG. 2 is a schematic illustration of a portion of an electrospinning apparatus according to an embodiment of the invention.

FIG. 2 illustrates one embodiment of the present invention. Apparatus 200 comprises a hollow cylindrical tube 210 having a longitudinal slit 220 along its entire length. A core polymer solution 230 can be introduced into the lumen of tube 210 in a volume sufficient for the surface of the solution to emerge through slit 220. In one example, tube 210 is 0.5-20 cm in diameter with a wall thickness of 50-5,000 microns. The cylindrical tube 210 is made of a conducting material such as stainless steel, copper, bronze, brass, gold, silver, platinum, and other metals and alloys. Slit 220 preferably has a width sufficient to permit formation of Taylor cones 240 from the surface of the core polymer solution 230, the width of slit 220 being generally between 0.01 and 20 millimeters, and preferably between 0.1 to 5 millimeters. The length of tube 210 is preferably between 5 centimeters and 50 meters, and more preferably between 10 centimeters and 2 meters.

In certain alternate embodiments, multiple apparatuses 200 may be placed in rows comprising up to 50 units, either in parallel or end-to-end, with a preference for 10 or fewer units per row. An advantage of using multiple units versus one long unit is better control over the flow of the polymer solutions.

The core polymer solution 230 preferably has a viscosity of between 10 and 10,000 centipoise, and is more preferably between 500 and 5,000 centipoise. Core polymer solution 230 is preferably pumped through the lumen of tube 210 and slit 220 at rates of between 0.01 and 10 milliliters per hour, more preferably between 0.1 and 2 milliliters per hour per centimeter. A voltage, preferably between 1 and 150 kV, more preferably between 20-70 kV, is applied. The positive electrode of the power supply is preferably connected to the conducting slit-cylinder directly or via a wire, such that a potential difference exists between the slit cylinder and a grounded collector 250. Grounded collector 250 is preferably placed at a distance between 1 and 100 centimeters from slit 220 and parallel to the axial dimension of tube 210. Grounded collector 250 is a planar plate of various geometries (e.g. rectangular, circular, triangular, etc.), rotating drum/rod, wire mesh, or other 3D collectors including spheres, pyramids, etc. Upon application of a sufficient voltage, Taylor cones 240 and electrospinning jets 241 will form in the exposed surface of polymer solution 230, and the jets will flow toward collector 250, forming homogeneous fibers.

Figure 3:
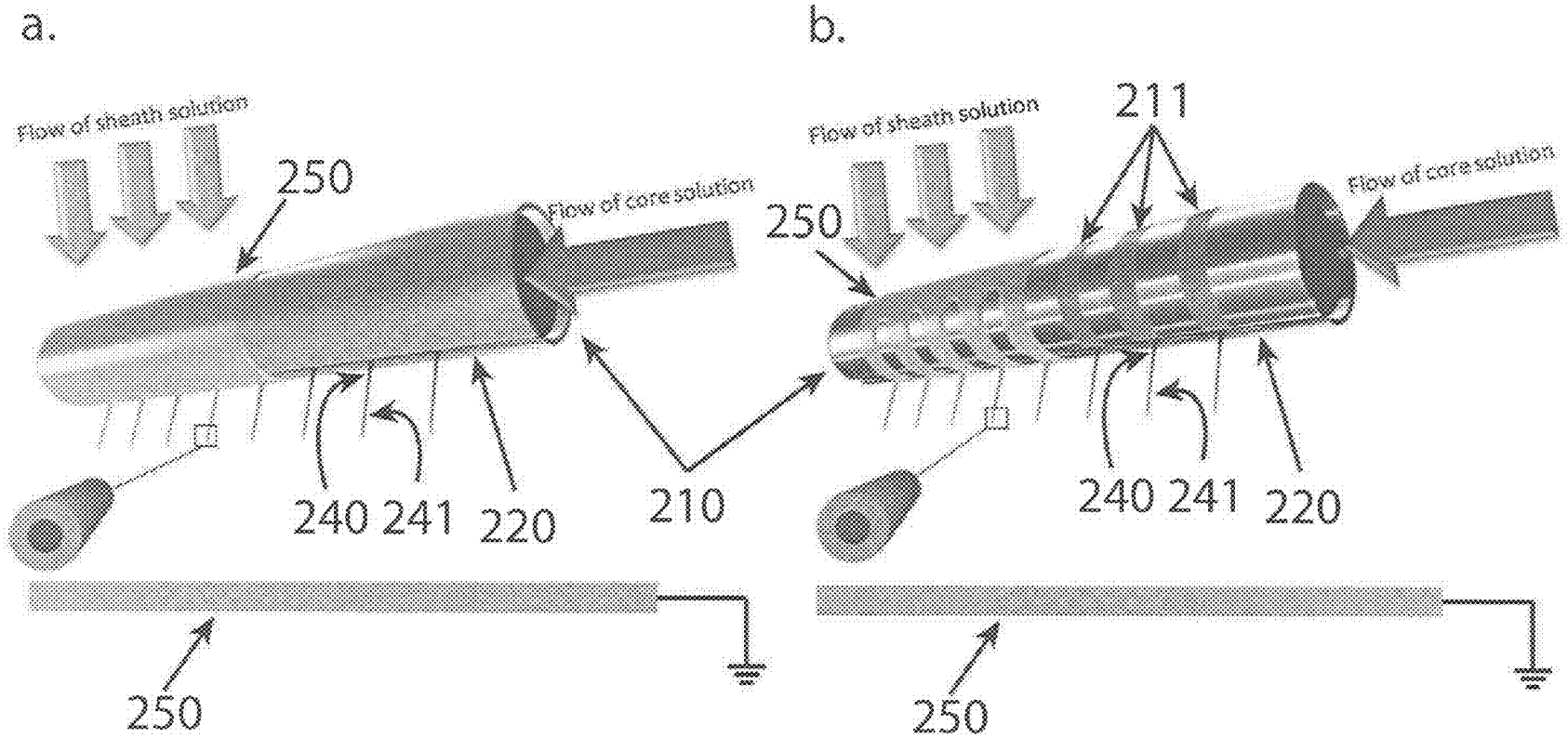
FIG. 3A-3B show schematic illustrations of a portion of an electrospinning apparatus according to an embodiment of the invention.

In certain embodiments of the present invention, the apparatus will include means for co-localizing a sheath polymer solution to the site of Taylor cone initiation, so that core-sheath fibers can be produced. In certain embodiments, such as that illustrated in FIG. 3, hollow cylindrical tube 210 will be arranged so that slit 220 points downward, and a sheath polymer solution 260 will be applied to the upward-facing external surface of tube 210 so that sheath polymer solution 260 runs down the sides of tube 210 and co-localizes with the core-sheath polymer at sites of Taylor cone and jet initiation 240, 241. Once the sheath polymer solution 260 is co-localized with the Taylor cone, it will be incorporated into the jet. The sheath polymer solution 260 is drawn toward and over the core fibers by varying the flow rate and viscosity of the sheath polymer solution 260, or by incorporating structural features 211 such as grooves, channels, coatings, and textured or smooth surfaces on the outer surface of hollow tube 210.

Figure 4:
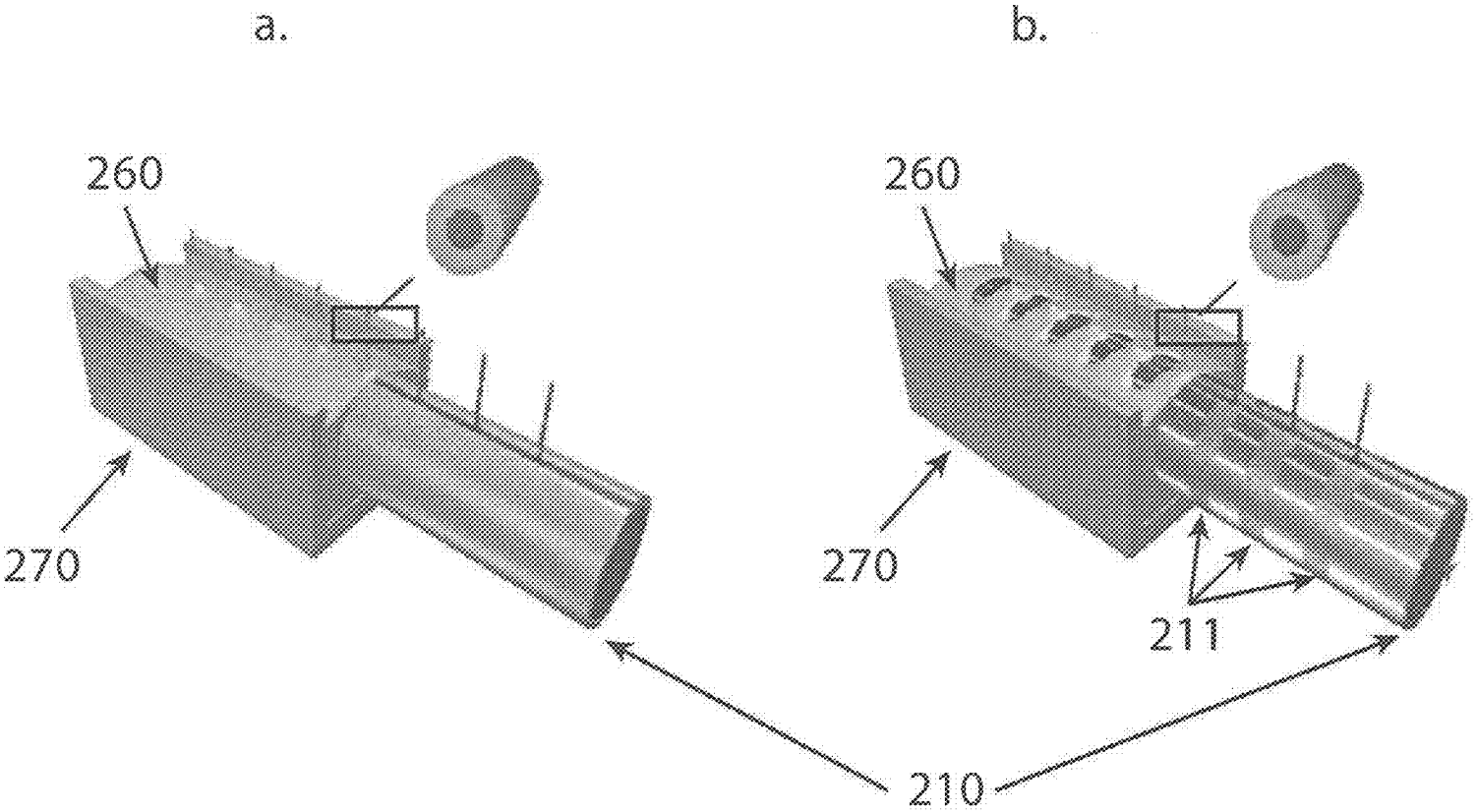
FIG. 4A-4B show schematic illustrations of a portion of an electrospinning apparatus according to another embodiment of the invention.

In certain alternate embodiments, as illustrated in FIG. 4, hollow tube 210 will be partially submerged in a bath 270 containing the sheath polymer solution 260. The volume of the sheath polymer solution 260 within bath 270 will be set at a level so that the top surface of the sheath polymer solution is at or near the sites of Taylor cone and jet initiation 240, 241. As described above, the rate at which sheath polymer solution 260 is drawn into fibers can be controlled by varying the viscosity of sheath polymer solution 260, or by incorporating structural features 211 on the outer surface of hollow tube 210 such as grooves, channels, coatings and textured or smooth surfaces.

In still other alternate embodiments, such as the one described in Example 2, infra, the sheath polymer solution 260 can be introduced directly to the sites of Taylor cone and jet initiation 240, 241, by using a syringe pump and needle. This method is preferred over previously used coaxial nozzle arrays, as single bore needles are used, reducing the likelihood of clogging.

Figure 5:
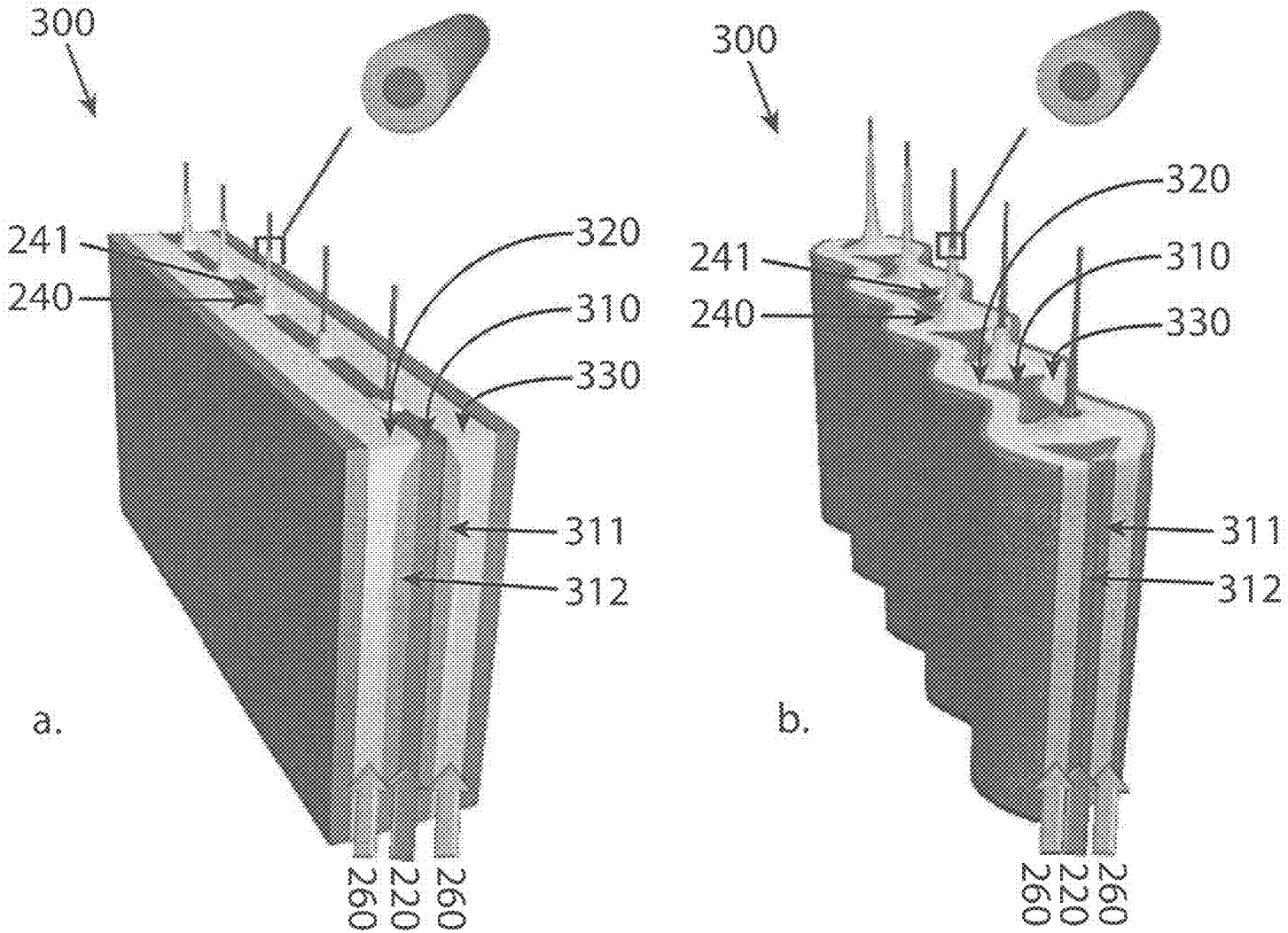
FIG. 5A-5B show schematic illustrations of a portion of an electrospinning apparatus according to yet another embodiment of the invention.

In an alternate embodiment of the present invention, three parallel troughs are utilized, as illustrated in FIG. 5. Apparatus 300 comprises an inner trough 310 and two outer troughs 320, 330. The walls 311, 312 of inner trough 310 are optionally tapered, so that their thickness decreases to zero at the top of inner trough 310. Inner trough 310 is filled with a solution of core polymer solution 220, which is pumped through inner trough 310 from the bottom up at rates suitable for electrospinning, generally between 0.1 to 2 milliliters per hour per centimeter, but up to 10 milliliters per hour per centimeter. Alternatively, the solution can be fed in from the sides or a combination of the bottom and sides. Inner trough 310 has a height ranging preferably from 5-10 centimeters and a width sufficient to permit formation of Taylor cones and jets 240, 241, which emerge from the surface of core polymer solution 220, the width of inner trough 310 being generally between 0.01 and 20 millimeters, and preferably between 0.1 to 5 millimeters. Outer troughs 320, 330 are filled with sheath polymer solutions 260 to heights sufficient for the sheath polymer solution to be drawn into the sites of Taylor cone and jet initiation 240, 241. As shown in FIG. 5*b*, walls 311, 312 of inner trough 310 may incorporate a reciprocal periodic wave structure, forming regions of higher and lower width within inner trough 310, which structure biases the formation of Taylor cones and jets 240, 241 to regions in which the width of inner trough is locally maximized. The voltage is applied by attaching the positive electrode of the power supply to the inner walls of the trough, which is composed of a metallic conducting material such as stainless steel, copper, bronze, gold, silver, platinum and other alloys.

Figure 6:
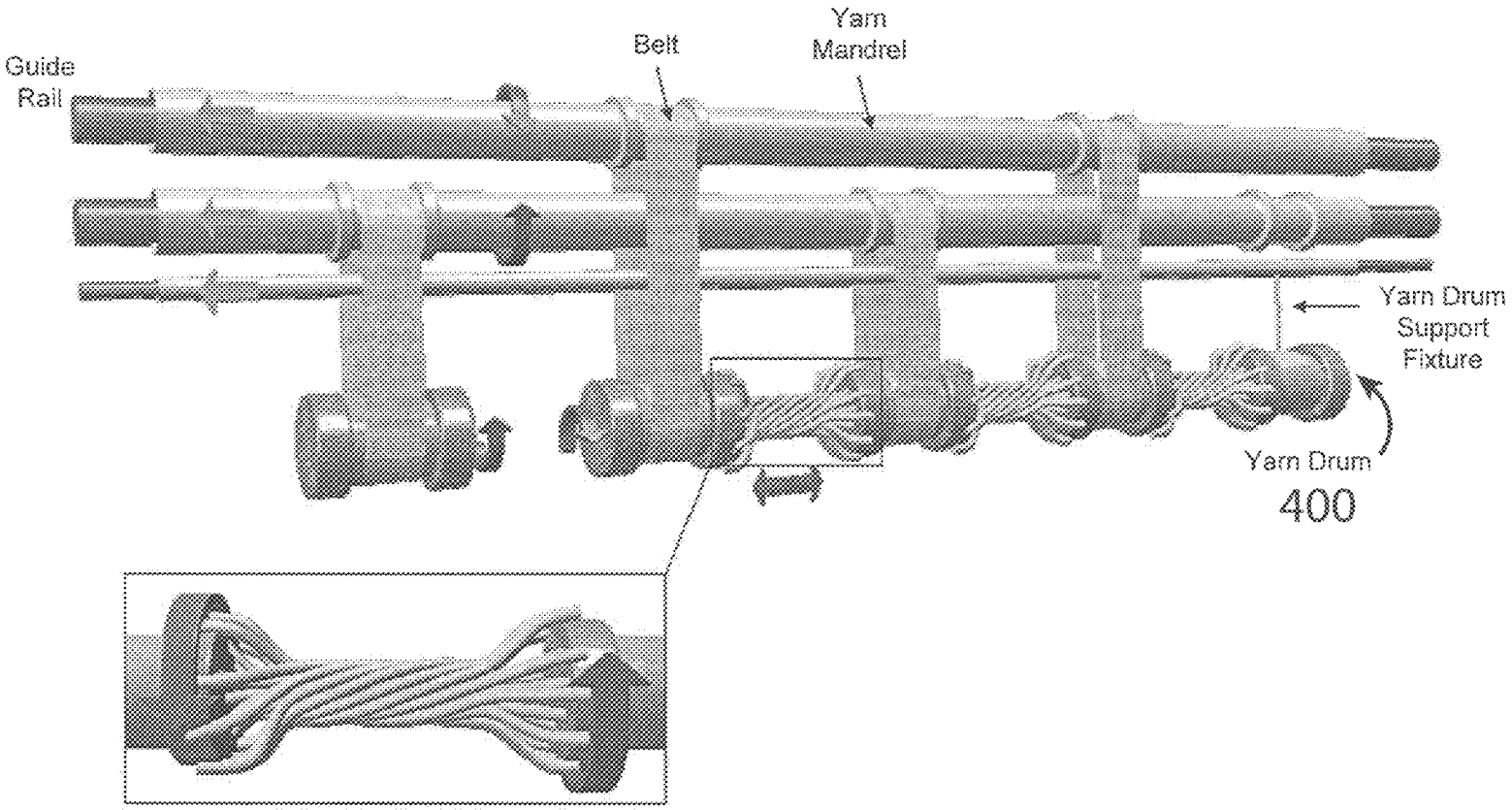
FIG. 6 is a schematic illustration of a yarn-making apparatus according to an embodiment of the invention.

In an alternate embodiment, the invention comprises a collector plate configured as a drum 400, which can be placed into a yarn-spinning apparatus as shown in FIG. 6. At any point during collection of fibers (prior to initiation, during collection, or after collection initiation), the drum is engaged with a belt that is in turn engaged with a mandrel that can spin in one direction, and free ends of the collected fibers are attached to another drum engaged with another belt that is engaged with a different mandrel which spins in a direction opposite from that of the first mandrel. The resulting yarns can be post-processed into higher-order structures such as ropes by attaching opposite ends of multiple yarns to opposing drums, and spinning them in opposite directions as described above.

In some embodiments of the invention, the polymers used in the present invention include additives such as metallic or ceramic particles to yield fibers having a composite structure.

The devices and methods of the present invention may be further understood according to the following non-limiting examples:

Example 1

Formation of Homogeneous Fibers

Figure 7:
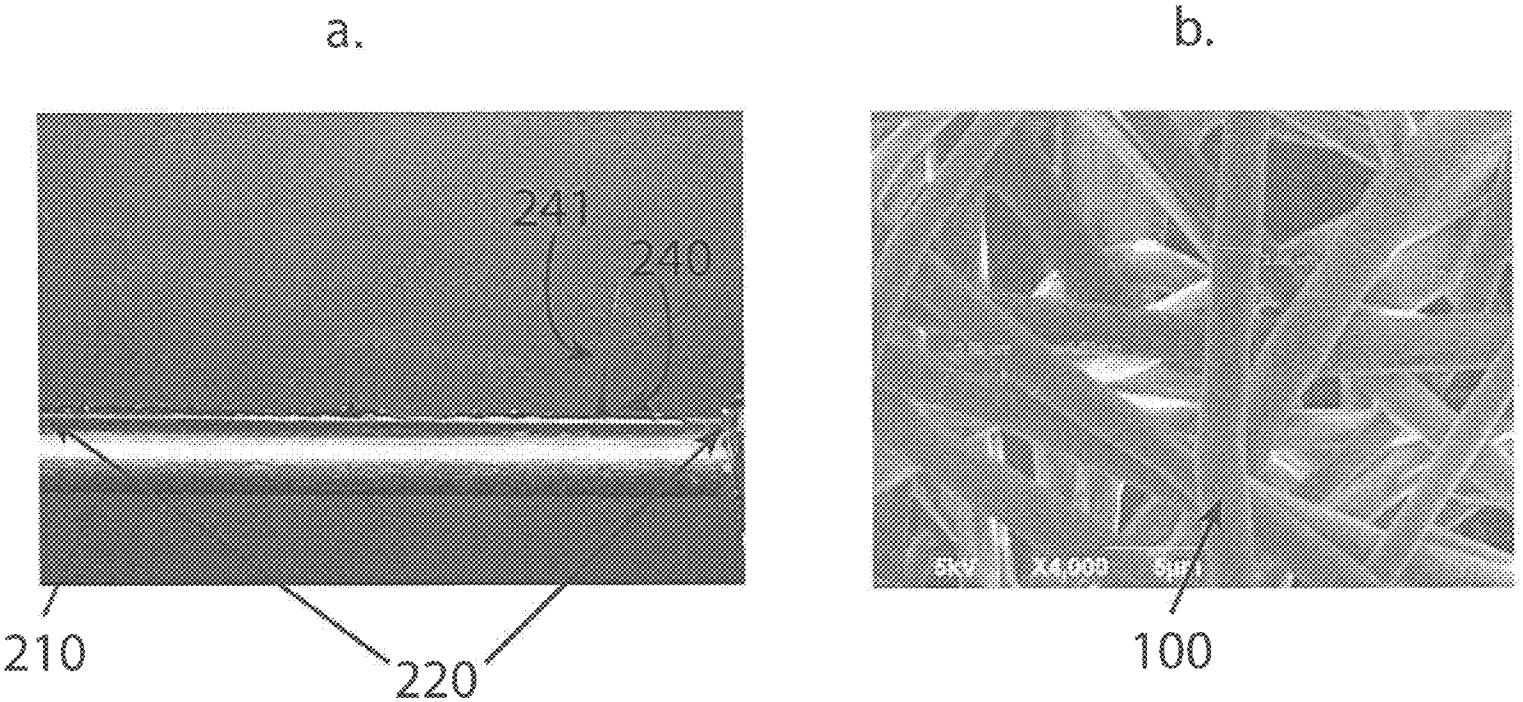
FIG. 7A-7B comprise photographs of an example of the present invention.

Homogeneous fibers made of poly(lactic co-glycolic acid) (L-PLGA) were manufactured in accordance with the present invention. A solution containing 4.5 wt % of 85/15 L-PLGA in hexafluoroisopropanol was pumped into one end of a 10 cm long hollow tube (1 cm diameter) having a 0.4 cm slit of the present invention at a rate of 8 milliliters per hour. A grounded, flat, rectangular collecting plate was placed approximately 15 centimeters from the slit of the cylinder, and a voltage of 25-35 kV was applied, and the resultant fibers were collected on the collecting plate and examined under scanning electron microscopy as illustrated in FIG. 7*b*.

Example 2

Formation of Core-Sheath Fibers

Figure 8:
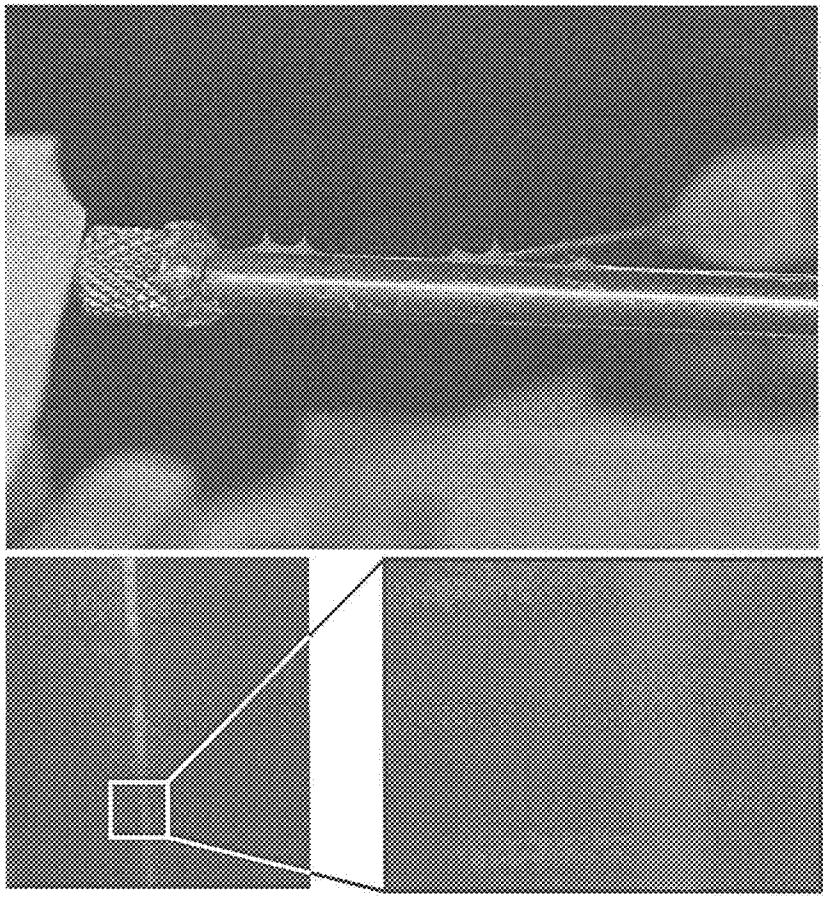
FIG. 8A-8B show photographs of another example of the present invention.

Core-sheath fibers were manufactured in accordance with the present invention, as shown in FIG. 8*a*. A rhodamine-containing core solution containing 15 wt % polycaprolactone in a 3:1 (by volume) chloroform:acetone solution was pumped through a hollow cylindrical tube having a slit therethrough at a rate of 10 ml/hour. Jets were formed by applying a voltage of 25 kV. Once the Taylor cones were stable, a syringe pump and needle filled with a fluorescein-containing sheath solution containing 15 wt % polycaprolactone in a 6:1 (by volume) chloroform:methanol solution was placed so that the needle was adjacent to one of the Taylor cones, and the sheath solution was pumped at a rate of 6 ml/hour. To verify the core-sheath structure of the resulting fibers, fluorescence micrographs were obtained which demonstrated that the rhodamine-containing core component was indeed surrounded by the fluorescein-containing sheath component, as shown in FIG. 8*b*.

The present invention provides devices and methods for producing homogeneous and core-sheath fibers. While aspects of the invention have been described with reference to example embodiments thereof, it will be understood by those skilled in the art that various changes in form and details may be made therein without departing from the scope of the invention.

We claim:

1. A method of forming a structure comprising a core including a first material and a sheath including a second material around said core, the method comprising the steps of:

providing the first material in a tube having an external surface with a longitudinal slit therein;

providing the second material to the external surface of said tube; and applying an electric field to at least a portion of the tube to thereby form a plurality of jets of said first and second materials.

2. The method of claim 1, wherein said structure is a fiber.

3. The method of claim 2, wherein said fiber has a diameter of less than 20 microns.

4. The method of claim 1, wherein said plurality of jets comprises at least eight jets.

5. The method of claim 1, wherein said slit has a width of between 0.01 and 20 millimeters.

6. The method of claim 5, wherein said slit has a width of between 0.1 and 5 millimeters.

7. The method of claim 6, wherein said tube has a length of between 5 centimeters and 50 meters.

8. The method of claim 1, wherein the first material is pumped into said tube at a rate of between 0.01 and 10 milliliters per hour.

9. The method of claim 1, further comprising the step of placing a collector at a distance of between 1 and 100 centimeters from said slit.

10. The method of claim 1, wherein said step of providing the second material to the external surface of said tube comprises at least partially submerging said tube in a bath containing the second material.

11. A method of forming a structure comprising a core including a first material and a sheath including a second material around said core, the method comprising the steps of:

providing three parallel troughs arranged as a first trough and second and third troughs on either side of the first trough;

providing the first material in the first trough;

providing the second material in each of the second and third troughs;

applying an electric field to the troughs to thereby form a plurality of jets of said first and second materials.

12. The method of claim 11, wherein said first trough has a width of between 0.1 to 5 millimeters.

13. The method of claim 11, wherein the first material is pumped through said first at a rate of between 0.1 to 10 milliliters per hour.

14. The method of claim 11, wherein said structure is a fiber.

15. The method of claim 14, wherein said fiber has a diameter of less than 20 microns.

16. The method of claim 15, wherein the diameter of the sheath of said fiber has a diameter that is about 1 to 7 microns larger than the diameter of the core of said fiber.

* * * * *